US008516832B2

(12) United States Patent
Bhavsar et al.

(10) Patent No.: US 8,516,832 B2
(45) Date of Patent: Aug. 27, 2013

(54) CONTROL SYSTEM FOR A FOOD AND BEVERAGE COMPARTMENT THERMOELECTRIC COOLING SYSTEM

(75) Inventors: Vishal Bhavsar, Rancho Cucamonga, CA (US); Qiao Lu, Placentia, CA (US); William Godecker, Irvine, CA (US)

(73) Assignee: B/E Aerospace, Inc., Wellington, FL (US)

( * ) Notice: Subject to any disclaimer, the term of this patent is extended or adjusted under 35 U.S.C. 154(b) by 393 days.

(21) Appl. No.: 12/871,002

(22) Filed: Aug. 30, 2010

(65) Prior Publication Data

US 2012/0047911 A1 Mar. 1, 2012

(51) Int. Cl.
*F25B 21/02* (2006.01)

(52) U.S. Cl.
USPC ..... 62/3.6; 62/3.7; 62/259.2

(58) Field of Classification Search
USPC ..... 62/3.6, 3.7, 259.2, 157, 129, 208, 62/287, 288; 165/287, 288
See application file for complete search history.

(56) References Cited

U.S. PATENT DOCUMENTS

| | | | | |
|---|---|---|---|---|
| 5,450,727 | A | 9/1995 | Ramirez et al. | |
| 5,689,957 | A | 11/1997 | DeVilbiss et al. | |
| 5,734,672 | A * | 3/1998 | McMinn et al. | 372/50.12 |
| 6,098,408 | A * | 8/2000 | Levinson et al. | 62/3.2 |
| 6,164,076 | A * | 12/2000 | Chu et al. | 62/3.7 |
| 6,182,453 | B1 * | 2/2001 | Forsberg | 62/125 |
| 6,408,630 | B2 * | 6/2002 | Macias et al. | 62/3.7 |
| 6,499,306 | B2 | 12/2002 | Gillen | |
| 6,634,177 | B2 * | 10/2003 | Lin et al. | 62/3.2 |
| 6,706,091 | B1 * | 3/2004 | Robinson et al. | 95/87 |
| 6,732,534 | B2 | 5/2004 | Spry | |
| 6,788,719 | B2 * | 9/2004 | Crowder | 372/38.02 |
| 6,953,424 | B2 * | 10/2005 | Kusumoto et al. | 494/10 |
| 7,134,293 | B2 * | 11/2006 | Rabal | 62/185 |
| 7,135,687 | B2 * | 11/2006 | Lacey et al. | 250/370.15 |
| 7,152,412 | B2 * | 12/2006 | Harvie | 62/3.5 |
| 7,185,500 | B2 * | 3/2007 | Meir | 62/3.2 |
| 7,290,395 | B2 | 11/2007 | Deal | |
| 7,377,622 | B2 * | 5/2008 | Nakazawa | 347/55 |
| 7,508,671 | B2 | 3/2009 | Sauciuc et al. | |
| 2006/0150657 | A1 | 7/2006 | Spurgeon et al. | |

(Continued)

FOREIGN PATENT DOCUMENTS

| | | | |
|---|---|---|---|
| WO | WO 99/10191 | A1 | 3/1999 |
| WO | WO 2004/011861 | A1 | 2/2004 |

*Primary Examiner* — Mohammad M Ali
(74) *Attorney, Agent, or Firm* — Drinker Biddle & Reath LLP

(57) ABSTRACT

A controller for a thermoelectric cooling system comprises a sensor input that receives input from a sensor that measures a performance parameter of a thermoelectric cooling system. The thermoelectric cooling system comprises a plurality of thermoelectric devices electrically coupled in a combination of in series and in parallel with one another and electrically driven by a common driver. The controller also comprises a voltage control signal output, a processor, and a non-transitory memory having stored thereon a program executable by the processor to perform a method of controlling the thermoelectric cooling system. The method comprises receiving sensor data from the sensor input, determining a parameter of the voltage control signal based on the input sensor data, and transmitting a voltage control signal having the parameter to the driver to control heat transfer by the plurality of thermoelectric devices. The voltage control signal may include a pulse width modulation signal having a pulse width modulation duty cycle, or a variable voltage control signal having a percentage of the maximum voltage of the variable voltage control signal.

28 Claims, 11 Drawing Sheets

(56) References Cited

U.S. PATENT DOCUMENTS

| | | | |
|---|---|---|---|
| 2008/0022695 | A1 | 1/2008 | Welle et al. |
| 2008/0022696 | A1 | 1/2008 | Welle et al. |
| 2008/0098750 | A1 | 5/2008 | Busier |
| 2008/0156031 | A1 | 7/2008 | Cur et al. |
| 2010/0071384 | A1 | 3/2010 | Lu et al. |

* cited by examiner

CONTROL SYSTEM FOR A FOOD AND BEVERAGE COMPARTMENT THERMOELECTRIC COOLING SYSTEM

BACKGROUND

Embodiments generally relate to a control system for a thermoelectric cooling system, and more particularly to a control system for a food and beverage compartment thermoelectric cooling system.

Conventional food and beverage refrigeration systems included in vehicles, such as aircraft, typically employ a vapor-compression refrigeration system. These vapor-compression refrigeration systems are typically heavy, prone to reliability problems, occupy a significant amount of space, and consume a significant amount of energy. In vehicles such as aircraft, reducing energy use is desirable at least because of the corresponding reduction in weight of equipment necessary to generate the energy. In addition, reducing equipment weight is desirable because of the reduction in fuel consumption required to operate the vehicle and corresponding increase in payload capacity for the vehicle. Reducing space occupied by refrigeration systems is also desirable to increase payload capacity for the vehicle. In addition, increasing reliability is also desirable at least because of the associated increase in operating time and reduction in maintenance costs for the vehicle.

SUMMARY

In an embodiment, a controller for a thermoelectric cooling system comprises a sensor input that receives input from a sensor that measures a performance parameter of a thermoelectric cooling system. The thermoelectric cooling system also comprises a plurality of thermoelectric devices electrically coupled in parallel with one another and electrically driven by a common driver. The controller also includes a voltage control signal output, a processor, and a non-transitory memory having stored thereon a program executable by the processor to perform a method of controlling the thermoelectric cooling system. The method includes receiving sensor data from the sensor input, determining a parameter of a voltage control signal based on the input sensor data, and transmitting the voltage control signal having the parameter to the driver to control heat transfer by the plurality of thermoelectric devices. The voltage control signal may include a linearly variable voltage control signal, and the parameter may include a percentage of the maximum voltage of the variable voltage control signal. The voltage control signal may also include a pulse width modulation signal, and the parameter may include a pulse width modulation duty cycle of the pulse width modulation signal. The voltage control signal may additionally include an on/off control signal.

In another embodiment, a thermoelectric cooling system comprises a first plurality of thermoelectric devices electrically coupled in series with a power supply, and a second plurality of thermoelectric devices electrically coupled in series with the power supply, wherein the first plurality and the second plurality of thermoelectric devices are electrically coupled in parallel with one another. A cold plate is coupled with a first side of the first plurality and second plurality of thermoelectric devices and operative to transfer heat from air in thermal contact with the cold plate to the first plurality and second plurality of thermoelectric devices. A heat sink is coupled with a second side of the first plurality and second plurality of thermoelectric devices and operative to transfer heat from the second side to a fluid coolant in thermal contact with the heat sink. A driver is electrically coupled in series between the power supply on one side and the first plurality and the second plurality of thermoelectric devices on another side. The driver is operative to control an amount of electrical power provided to the first plurality and the second plurality of thermoelectric devices from the power supply according to a voltage control signal. A sensor measures a performance parameter of at least one of the first plurality and second plurality of thermoelectric devices. The thermoelectric cooling system also comprises a controller including a processor and a non-transitory memory having stored thereon a program executable by the processor to perform a method of controlling the thermoelectric cooling system. The method comprises receiving sensor data from the sensor, determining a parameter of the voltage control signal based on the sensor data, and transmitting the voltage control signal to the driver.

In another embodiment, a thermoelectric refrigerator comprises a chilled compartment that holds food or beverages at a temperature lower than an ambient air temperature, and a plurality of thermoelectric devices electrically coupled in parallel with one another. The plurality of thermoelectric devices have a cold side and a hot side. The thermoelectric refrigerator also comprises a fan that circulates air between thermal contact with the cold side of the plurality of thermoelectric devices and an interior of the chilled compartment and driven by variably controlled electrical power. The thermoelectric refrigerator also comprises a heat sink in thermal contact with the hot side of the plurality of thermoelectric devices. The heat sink transfers heat between the hot side of the plurality of thermoelectric devices and a fluid coolant that circulates in thermal contact therewith. The thermoelectric refrigerator also comprises a thermoelectric device power supply electrically coupled with the plurality of thermoelectric devices and that converts power from an input power source to drive the plurality of thermoelectric devices. A control system power supply is electrically coupled with a controller that is electrically isolated from the plurality of thermoelectric devices and that converts power from the input power source to power the controller. A driver is electrically coupled in series with the plurality of thermoelectric devices. The driver controls electrical current from the thermoelectric device power supply input to the plurality of thermoelectric devices in response to a thermoelectric device driving signal. A current sensor is electrically coupled with at least one of the plurality of thermoelectric devices and measures electrical current that passes therethrough. A voltage sensor is electrically coupled with the plurality of thermoelectric devices and measures an electrical voltage input to the plurality of thermoelectric devices. A thermoelectric device temperature sensor is thermally coupled with one side of at least one of the plurality of thermoelectric devices and measures a temperature of the one side of the at least one of the plurality of thermoelectric devices. A circulating air temperature sensor measures a temperature of air that circulates in thermal contact with the cold side of the plurality of thermoelectric devices. A fluid coolant temperature sensor measures a temperature of the fluid coolant that circulates in thermal contact with the heat sink on the hot side of the plurality of thermoelectric devices. The thermoelectric refrigerator also comprises a controller including a processor and a non-transitory memory having stored thereon a program executable by the processor to perform a method of controlling the thermoelectric refrigerator. The method comprises receiving sensor data from a plurality of sensors including the current sensor, the voltage sensor, and the temperature sensors, determining a parameter of the thermoelectric device driving signal based on at least the sensor data, transmitting the thermoelectric device driving signal having the parameter to the driver, and setting the variably controlled electrical power driving the fan based on the sensor data. The thermoelectric device driving signal may include a pulse width modulation signal, and the parameter may include a pulse width modulation duty cycle.

DETAILED DESCRIPTION

Embodiments of a control system for a thermoelectric cooling system that overcome problems of the prior art are disclosed herein. The control system for a thermoelectric cooling system may be included in a vehicle, e.g., an aircraft, to control a refrigeration unit such as a food and beverage refrigerator used in a galley.

Figure 1A:
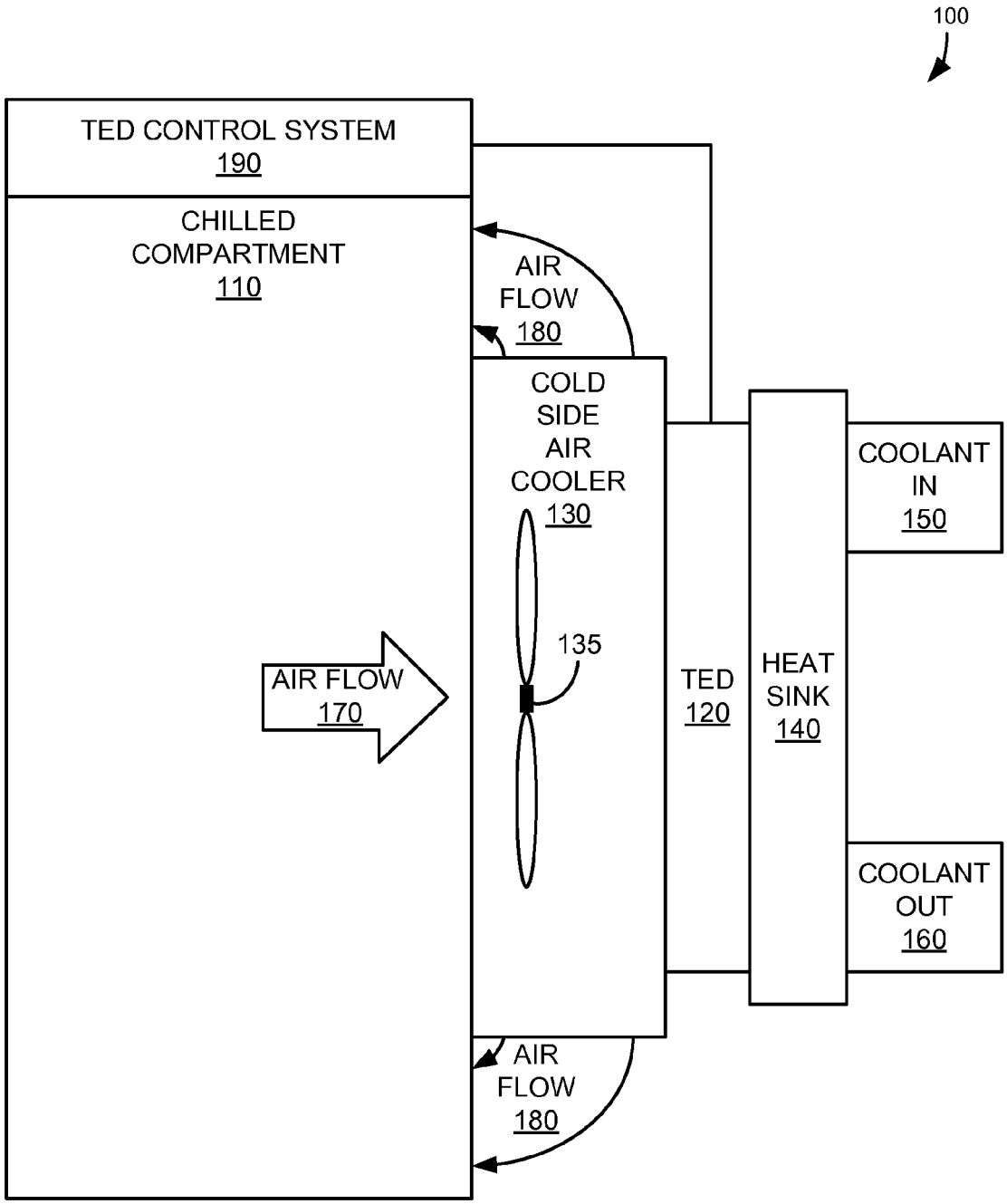
FIGS. 1A and 1B illustrate exemplary embodiments of a thermoelectric cooling system.
Figure 1B:
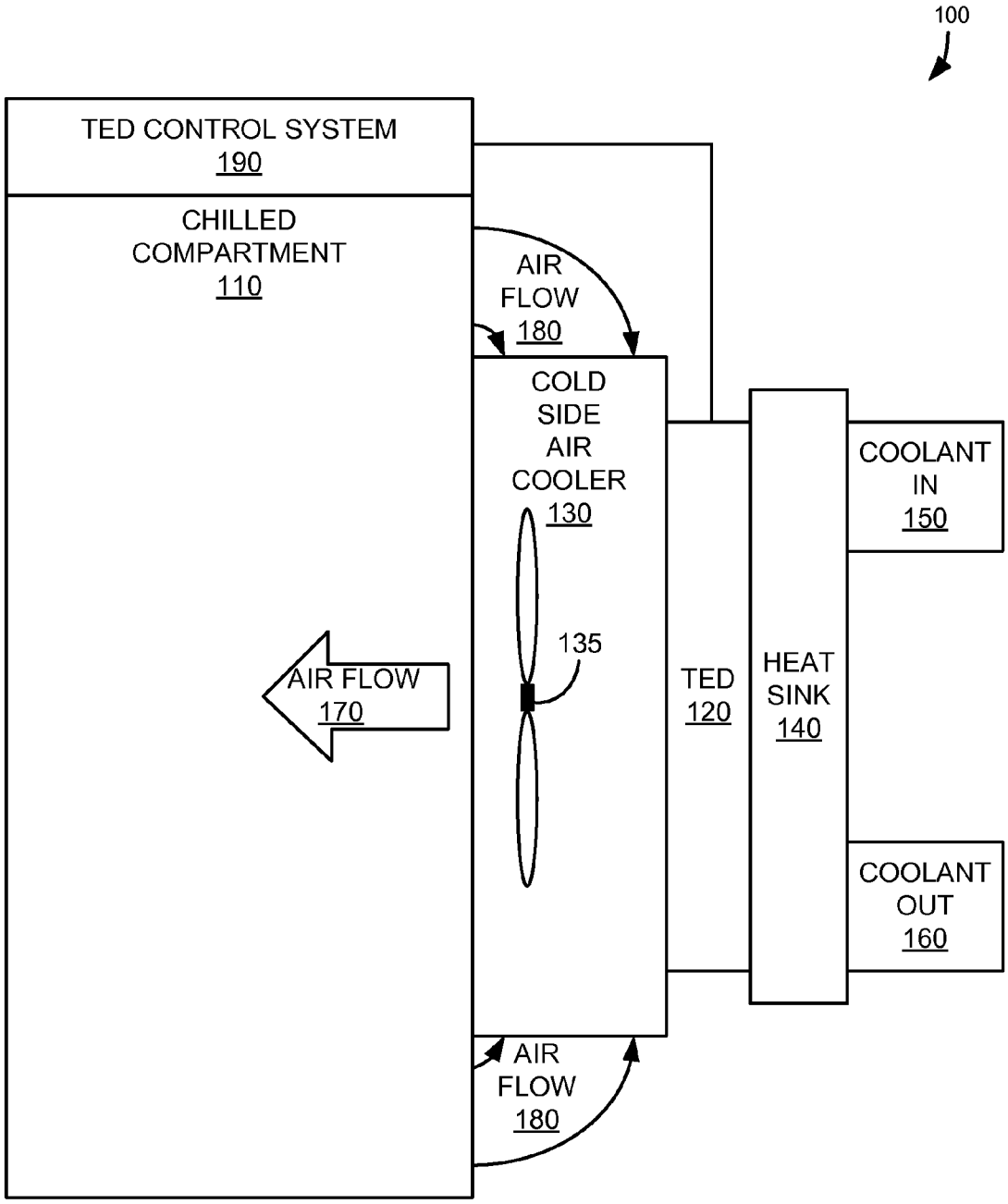

FIGS. 1A and 1B illustrate exemplary embodiments of a thermoelectric cooling system 100. The thermoelectric cooling system 100 may include a refrigerator for refrigerating items such as food and beverages. The thermoelectric cooling system 100 may be used in a vehicle such as an aircraft, ship, train, bus, or van. The thermoelectric cooling system 100 includes a chilled compartment 110 in which the items to be refrigerated may be held at a temperature lower than an ambient air temperature outside the chilled compartment 110. The chilled compartment 110 may have a door that can be opened for access to the chilled compartment 110, and closed to secure the items to be refrigerated within an insulated temperature-controlled space within the chilled compartment 110.

The thermoelectric cooling system 100 may cool the chilled compartment 110 using a thermoelectric device (TED) 120. The thermoelectric cooling system 100 may include a plurality of TED 120's as described in more detail elsewhere herein. The TED 120 may include a Peltier device that uses the Peltier Effect to transfer heat from one side of the TED 120 to another side of the TED 120. Using the Peltier Effect, a voltage or DC current is applied across two dissimilar conductors, thereby creating an electrical circuit which transfers heat in a direction of charge carrier movement. The direction of heat transfer through the TED 120 may be controlled by a polarity of voltage applied across the Peltier device of the TED 120. For example, when a voltage is applied at a positive polarity, the TED 120 may transfer heat from a cold side air cooler 130 to a heat sink 140. The positive polarity may be used in the standard operating condition of the TED 120 in a cooling mode of the thermoelectric cooling system 100. When the voltage is applied at a negative polarity, the TED 120 may transfer heat from the heat sink 140 to the cold side air cooler 130. The negative polarity may be used in an alternate operating condition of the TED 120 such as in a defrost mode of the thermoelectric cooling system 100.

The cold side air cooler 130 may be operative to transfer heat from air into the TED 120 via thermal contact with a heat exchanger. The cold side air cooler 130 may include a fan 135. The fan 135 may include an axial fan, a radial fan, a centrifugal fan, or another type of fan as known to one of ordinary skill in the art. A speed of the fan 135, and consequently an amount of air flow circulated by the fan, may be set by a variably controlled electrical power used to drive a motor of the fan 135. The speed of the fan 135 may be measured in units of revolutions per minute (rpm). The fan 135 may cause air flow 170 to circulate from an interior of the chilled compartment 110 into the cold side air cooler 130 (FIG. 1A), or vice versa (FIG. 1B), depending on a direction of rotation of the fan (e.g., whether the fan rotates in a clockwise or a counter-clockwise direction). The cold side air cooler 130 may also include a heat exchanger such as a cold plate or fins coupled with the TED 120 that is operative to transfer heat from the air circulated by the fan 135 into the TED 120. In the embodiment illustrated in FIG. 1A, after heat is transferred from the air to the TED 120 via thermal contact with the heat exchanger, the fan 135 may cause the air to exit the cold side air cooler 130 and re-enter the chilled compartment 110 via air flow 180. The air flow 180 may be guided by one or more ducts or other structures coupled with the cold side air cooler 130 to guide air into the chilled compartment 110 after being cooled by the cold side air cooler 130. In the embodiment illustrated in FIG. 1B, the air flow 180 may be guided by one or more ducts or other structures coupled with the cold side air cooler 130 to guide air from the chilled compartment 110 into the cold side air cooler 130 to be cooled before being returned to the chilled compartment 110. After heat is transferred from the air to the TED 120 via thermal contact with the heat exchanger, the fan 135 may cause the air to exit the cold side air cooler 130 and re-enter the chilled compartment 110 via air flow 170.

The heat sink 140 may be in thermal contact with the TED 120 and operative to transfer heat from the TED 120 into a fluid coolant that circulates in thermal contact with the heat sink 140. The fluid coolant may include a liquid coolant such as water or a glycol/water mixture, or a gaseous coolant such as cool air. In some embodiments, the fluid coolant may be provided to the thermoelectric cooling system 100 by a central liquid coolant system of a vehicle such as an aircraft. The fluid coolant may be provided to the heat sink 140 via a coolant input port 150. After the heat sink 140 exchanges heat between the TED 120 and the fluid coolant, the fluid coolant may be output via a coolant output port 160.

A TED control system 190 may be coupled with the TED 120 to control operation of the TED 120 in cooling and warming (e.g., defrosting) the chilled compartment 110. The TED control system 190 may also control other components and aspects of the thermoelectric cooling system 100, including the fan 135 and flow of fluid coolant through the heat sink 140. For example, the flow of fluid coolant through the heat sink 140 may be controlled by opening and closing valves coupled in line with the coolant input port 150 and coolant output port 160, and the TED control system 190 may control a rotational speed of the fan 135 by varying an amount of electrical power provided to a motor of the fan 135. The TED control system 190 may include a processor and non-transitory memory having stored thereon a program executable by the processor for performing a method of controlling the thermoelectric cooling system 100. The TED control system 190 may include a field programmable gate array (FPGA), an application specific integrated circuit, or other electronic circuitry to perform a method of controlling the thermoelectric cooling system 100. The TED control system 190 may also be communicatively coupled with a plurality of sensors within the thermoelectric cooling system 100, and thereby receive sensor data pertaining to measurements of performance parameters of the thermoelectric cooling system 100 and constituent components. The input/output and control functions of the TED control system 190 pertaining to the TED 120 are described in more detail herein with reference to FIG. 3.

Figure 2:
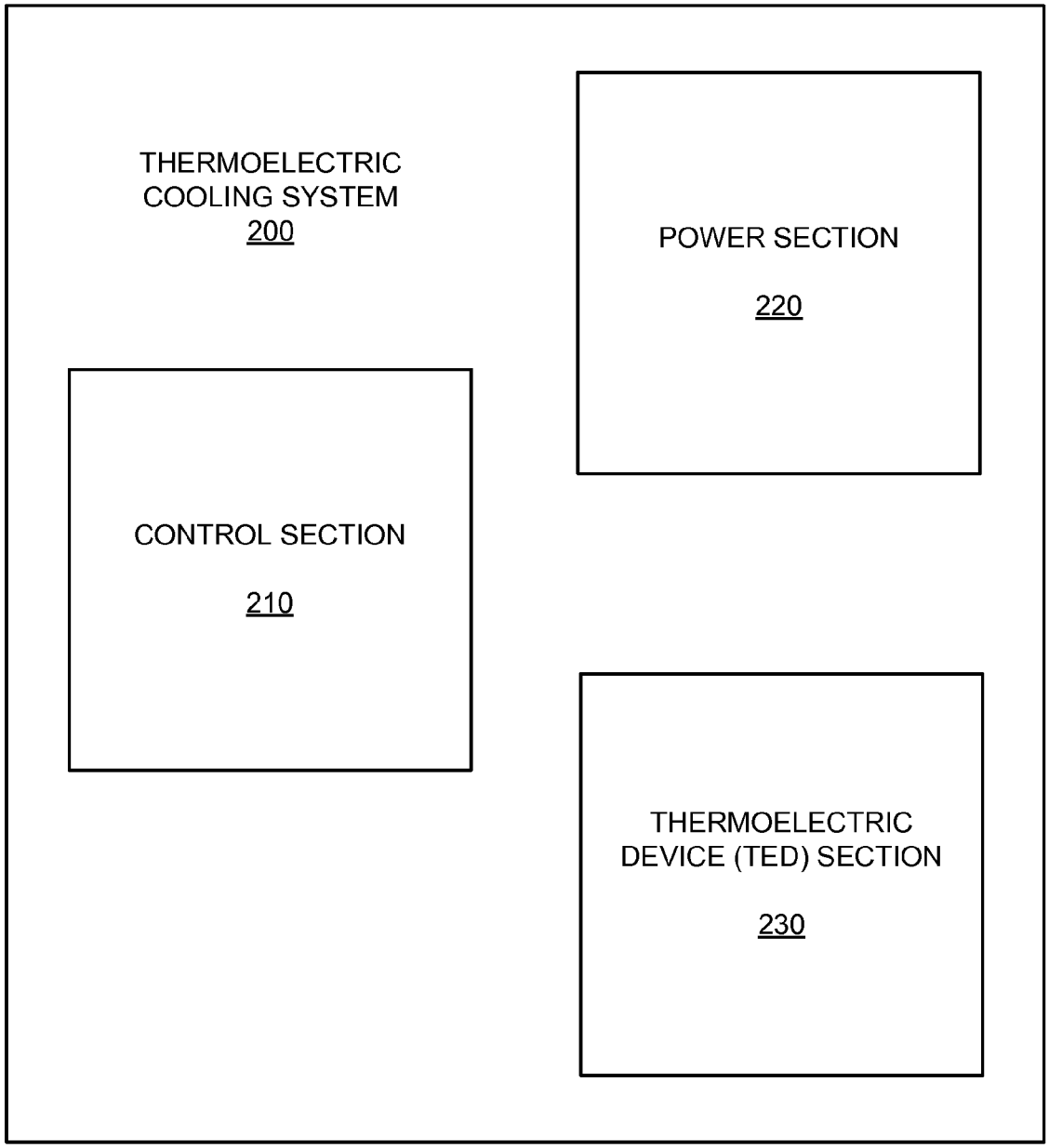
FIG. 2 illustrates an exemplary thermoelectric cooling system partitioned into a control section, a power section, and a thermoelectric device (TED) section.

FIG. 2 illustrates an exemplary thermoelectric cooling system 200 partitioned into a control section 210, power section 220, and thermoelectric device (TED) section 230. The thermoelectric cooling system 200 may include an embodiment of the control system 190 and the TED 120. The control section 210 may be electrically isolated from the power section 220 and the TED section 230. The electrical isolation of the control section 210 from the power section 220 and the TED section 230 may prevent electrical noise and transients due to high power switching of the TED section 230 from propagating into the control section 210. The electrical isolation may be provided using opto-isolators or other means. Components and operations of the control section 210, power section 220, and TED section 230 are described in more detail with reference to FIG. 3.

Figure 3:
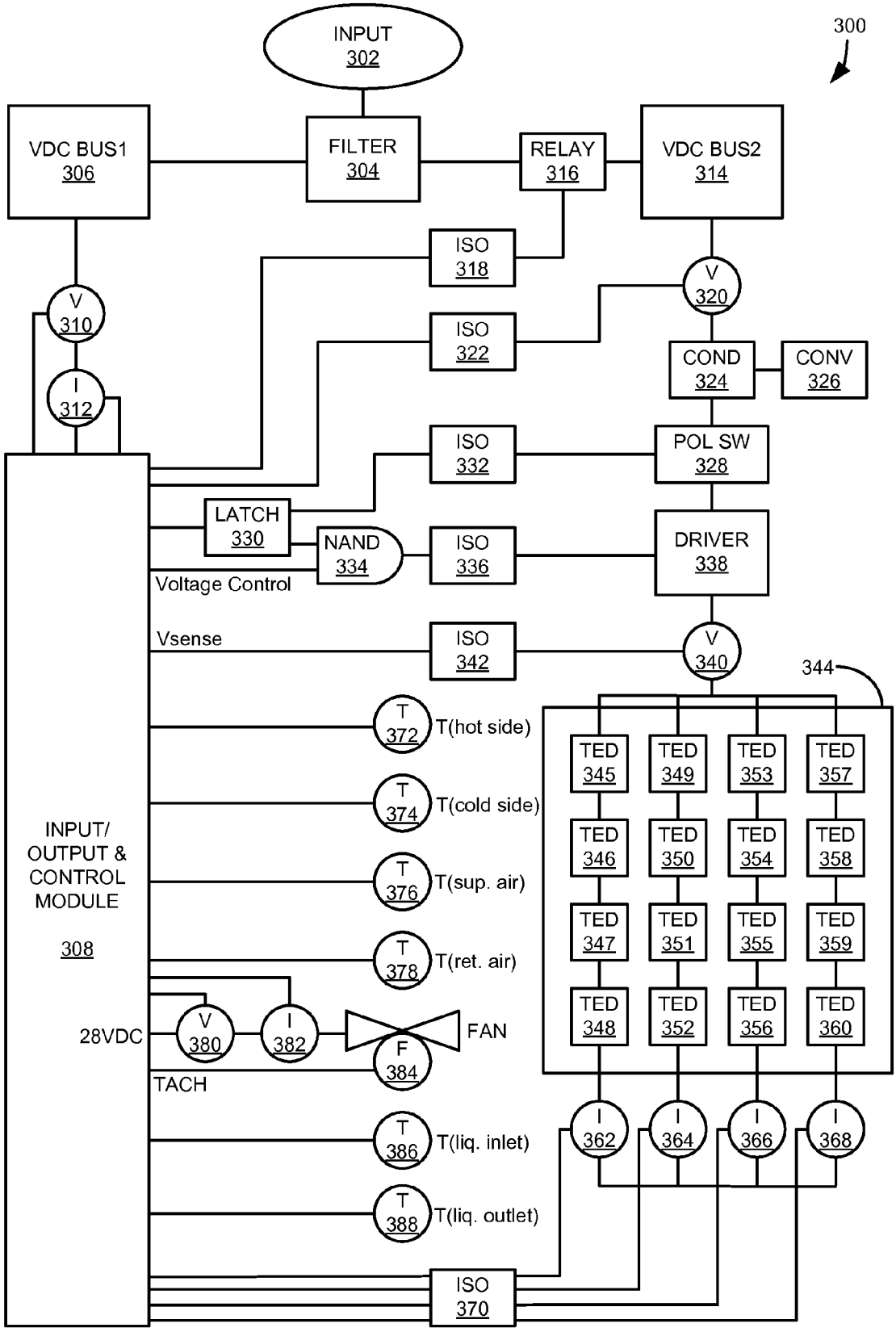
FIG. 3 illustrates another exemplary thermoelectric cooling system.

FIG. 3 illustrates another exemplary thermoelectric cooling system 300. The thermoelectric cooling system 300 may include an embodiment of the thermoelectric cooling system 200. The thermoelectric cooling system 300 includes a power input 302. The input 302 may couple with three-phase alternating current (AC) power. In some embodiments, the three-phase AC power may have a voltage of approximately between 80 VAC and 180 VAC, or other standard voltage values as may be used in power systems of aircraft. The power at input 302 may include power from an aircraft electrical power generating system. The power at input 302 may be filtered by a filter 304. The filter 304 may include an electromagnetic interference (EMI) filter. The filter 304 may also include an electrical fuse for safety reasons. The power output of the filter 304 may be routed to both a VDC BUS1 power supply 306 and a VDC BUS2 power supply 314. In some embodiments, the VDC BUS1 power supply 306 may supply a voltage of 28 volts direct current (VDC), while the VDC BUS2 power supply 314 may supply a voltage of 48 VDC. Embodiments are not limited to these exemplary voltage values, and in other embodiments, different voltage values may be supplied depending upon system requirements or design goals. The power from the filter 304 to the VDC BUS2 power supply 314 may be selectively connected or disconnected by a controllable relay 316. The VDC BUS1 power supply 306 may be used to power a control section of the thermoelectric cooling system 300 that corresponds to control section 210, while the VDC BUS2 power supply 314 may correspond with the power section 210 and also be used to power a thermoelectric device (TED) corresponding to the TED section 230.

The VDC BUS1 power supply 306 may output approximately 100 volt-amperes (VA) of direct current electrical power at a nominal 28 volts. The VDC BUS1 power supply 306 may also include transient protection to protect electronics of the thermoelectric cooling system 300 corresponding to the control section 210 from damage caused by electrical transients input to the VDC BUS1 power supply 306. Electrical power may be output from the VDC BUS1 power supply 306 and into an input/output and control module 308. The control module 308 may convert the input power from the VDC BUS1 power supply 306 into one or more different voltages. For example, the control module 308 may convert the input power from the VDC BUS1 power supply 306 into 5V for operating electronic circuits included in the control module 308.

The control module 308 may include a microcontroller or processor and associated non-transitory memory having stored thereon a program executable by the processor to control components of the thermoelectric cooling system 300. Components of the control module 308 may be mounted on one or more printed circuit boards. The control module 308 may also include one or more various regulators, sensor interfaces, fan control circuitry, analog and discrete inputs and outputs, and a controller area network (CAN) bus interface. The control module 308 may be communicatively coupled with a variety of sensors that input data corresponding to performance measurements relating to the thermoelectric cooling system 300. A voltage sensor 310 and a current sensor 312 may measure electrical power output from the VDC BUS1 power supply 306 and into the control module 308. The sensor data output from the voltage sensor 310 and the current sensor 312 may be provided to the control module 308. Likewise, a voltage sensor 320 may measure electrical voltage output from the VDC BUS2 power supply 314 and another voltage sensor 340 may measure electrical voltage input to a TED array 344 corresponding to the TED section 230 and comprising a plurality of thermoelectric devices. The sensor data output from the voltage sensor 320 and the voltage sensor 340 may pass through an isolator 322 and an isolator 342, respectively, before being input to the control module 308.

The control module 308 may also receive sensor data from additional sensors associated with the control section 210. A series of thermistors may be installed in the thermoelectric cooling system 100 to measure temperatures on or near various components. A temperature sensor 372 may be thermally coupled with a hot plate of the heat sink 140 which is thermally coupled with a hot side of the TED 120, and may measure a temperature of the hot side. A temperature sensor 374 may be thermally coupled with a cold plate of the cold side air cooler 130 which is thermally coupled with a cold side of the TED 120, and may measure a temperature of the cold side. A temperature sensor 376 may measure a temperature of an air flow of supply air circulating through the cold side air cooler 130. A temperature sensor 378 may measure a temperature of an air flow of return air circulating through the cold side air cooler 130. A temperature sensor 386 may measure a temperature of fluid coolant flowing in through the coolant input port 150. A temperature sensor 388 may measure a temperature of fluid coolant flowing out through the coolant output port 160.

The fan 135 may be operationally coupled with a number of sensors that measure performance parameters related to the fan 135. A number of revolutions per minute (rpm) of the fan 135 may be measured by a fan rpm sensor 384. The rpm's of the fan 135 may correlate with an airflow through the fan 135. A voltage sensor 380 and a current sensor 382 may measure an electrical voltage and an electrical current of an electrical power provided by the control module 308 to drive the fan 135, respectively.

Using the data received from the sensors in the thermoelectric cooling system 300 that input sensor data to the control module 308, the control module 308 may control power and thermoelectric devices corresponding to the power section 220 and the TED section 230, respectively. The control module 308 may control electrical current input to the TED array 344 from the VDC BUS2 power supply 314 via a driver 338 electrically coupled in series with the TED array 344 such that the plurality of thermoelectric devices in the TED array 344 are electrically driven by the common driver 338. The driver 338 may include a field effect transistor (FET)/insulated gate bipolar transistor (IGBT) driver. The driver 338 may be temperature and current protected. The driver 338 may be electrically isolated from the control module 308 by an isolator 336.

A voltage polarity of the electrical power input to the TED array 344 from the VDC BUS2 power supply 314 may be controlled by the control module 308 via a polarity switch 328 electrically coupled in series with the driver 338. The polarity switch 328 may include a mechanical switch or a solid state relay (SSR). The polarity switch 328 may be controlled via a delay latch 330 that delays and latches a control signal from the control module 308. The polarity switch 328 may also be electrically isolated from the control module 308 by an isolator 332. The polarity of the TED array 344 may be reversed in order to alternately place the TED array 344 into a cooling mode and a defrost mode. When the TED array 344 is in a cooling mode (e.g., a freezer mode, a refrigeration mode, or a beverage chilling mode), the TED array 344 may cool the chilled compartment 110 by transferring heat from the cold side air cooler 130 to the heat sink 140. Alternately, when the TED array 344 is in a defrost mode, the TED array 344 may defrost the chilled compartment 110 by transferring heat from the heat sink 140 to the cold side air cooler 130.

When the control module 308 sets the polarity switch 328 to reverse polarity of the TED array 344 such that the TED array 344 is in a defrost mode, the NAND circuit 334 may be set to override the voltage control signal output from the control module 308 and thereby prevent the voltage control signal from controlling the driver 338. In this way, the driver 338 may be set to provide full power to the TED array 344 when the TED array 344 is set to defrost mode by the polarity switch 328, and the voltage control signal may only be used to control a power level of the TED array 344 when the TED array 344 is in a cooling mode.

The VDC BUS2 power supply 314 may output direct current (DC) electrical power at a nominal voltage and with a sufficient amperage to power the cooling operations of the TED array 344. In some embodiments, the VDC BUS2 may provide approximately 750 VA of DC power at 48 VDC, but embodiments are not limited to these exemplary power and voltage values, as many different values may be implemented depending upon cooling system requirements and design goals. The VDC BUS2 power supply 314 may include an eighteen-phase thirty-six-pulse autotransformer rectifier unit (ATRU) or a poly-phase transformer to provide the output direct current electrical power. The VDC BUS2 power supply 314 may also include transient protection to protect electronics of the thermoelectric cooling system 300 corresponding to the power section 220 and the TED section 230 from damage caused by electrical transients input to the VDC BUS2 power supply 314.

The output of the VDC BUS2 power supply 314 may be primarily or only used to provide power to the TED array 344. A DC/DC condition circuit 324 may condition the electrical power output from the VDC BUS2 power supply 314 to help provide clean power to the TED array 344. A DC/DC converter 326 may also be coupled with the DC/DC condition circuit 324. The DC/DC converter 326 may have a voltage conversion ratio that converts one input voltage (e.g., 75V) to another output voltage (e.g., 5V). In addition, a thermal manual-resettable switch may be installed in line between the VDC BUS2 power supply 314 and the TED array 344 to provide over-heat protection.

The TED array 344 may support normal operations at various electrical voltages depending upon the series and parallel arrangement of thermoelectric devices within the TED array 344 (e.g., in some embodiments up to 64 VDC). The TED array 344 may include one or more thermoelectric devices (TEDs). The TEDs may be arranged in a first group and a second group which are electrically coupled in parallel within one another, and one or more TEDs may be electrically connected in series with one another in each of the first group and the second group. For example, the TEDs may be arranged in an array in which two or more TEDs are electrically coupled in series, and two or more TEDs are electrically coupled in parallel. As illustrated in FIG. 3, sixteen TEDs are arranged in an array in which four groups of TEDs are electrically coupled with each other in parallel, while the four TEDs within each of these four groups are electrically coupled in series. In particular, TEDs 345, 346, 347, and 348 are connected in series in a first group, TEDs 349, 350, 351, and 352 are connected in series in a second group, TEDs 353, 354, 355, and 356 are connected in series in a third group, and TEDs 357, 358, 359, and 360 are connected in series in a fourth group. The first, second, third, and fourth group are electrically coupled with each other in parallel between an input and an output of the TED array 344. In various embodiments, as one of ordinary skill would recognize, the TED array 344 may include more or fewer thermoelectric devices than illustrated in FIG. 3, and the thermoelectric devices may be arranged in various other groupings in series and parallel. Each of the TEDs in the TED array 344 may be physically spaced apart from the other TEDs in the TED array 344 to improve efficiency of heat transfer or prevent over-heat conditions.

Electrical current passing through each of the first, second, third, and fourth groups of TEDs is measured by current sensors that provide their data to the control module 308 via an isolator 370. In particular, the electrical current that passes through the first group of TEDs is measured by current sensor 362, the electrical current that passes through the second group of TEDs is measured by current sensor 364, the electrical current that passes through the third group of TEDs is measured by current sensor 366, and the electrical current that passes through the fourth group of TEDs is measured by current sensor 368. Using the measured voltage across the TED array 344 provided by the voltage sensor 340 and the measured current that passes through each of the four groups of TEDs provided by the current sensors 362, 364, 366, and 368, the control module 308 may calculate the total power used by the TED array 344.

The control module 308 may control the relay 316 to connect and disconnect the VDC BUS2 power supply 314 with the power input 302. For example, when the thermoelectric cooling system controlled by the thermoelectric cooling system 300 is on standby mode, turned off, or safety conditions such as over-current, over-heat, etc. necessitate the disconnection of power from the TED array 344, the control module 308 may control the relay 316 via an isolator 318 to electrically disconnect the VDC BUS2 power supply 314 from the electrical input power provided by the power input 302. When the control module 308 determines that power should be provided to the TED array 344, the control module 308 may control the relay 316 to electrically connect the VDC BUS2 power supply 314 to the electrical input power provided by the power input 302.

The control module 308 may use voltage control, on/off control, or pulse width modulation (PWM) to control the power of the TED array 344 by outputting a voltage control signal. The voltage control may include nonlinear as well as linear voltage control, in which the voltage may be controlled nonlinearly or linearly in response to either desired levels of cooling or cooling system sensor inputs.

In embodiments where variable voltage control is used, the voltage control signal output from the control module 308 may vary from about 0% to about 100% of a nominal full control voltage value to vary the power of the TED array 344 from about 0% to about 100% of full power. The value of the variable voltage control signal may be set according to sensor data received by the control module 308 from the various temperature, current, voltage, and rpm sensors in the thermoelectric cooling system 100. Additionally, the value of the variable voltage control signal may be set according to a set mode of operation of the thermoelectric cooling system 100, e.g., refrigeration mode, beverage chilling mode, freezer mode, or defrost mode. When the value of the voltage control signal is increased, the TED array 344 may provide more cooling to the chilled compartment 110, and when the value of the voltage control signal is reduced, the TED array 344 may provide less cooling to the chilled compartment 110. Embodiments where on/off control is used may operate similarly to embodiments where variable voltage control is used, except that the voltage control signal may only be set to on (100% of full power) and off (0% of full power).

In embodiments where PWM control is used, the voltage control signal may be a PWM signal and the control module 308 may generate a pulse frequency of greater than about 2 kHz as a basis for the PWM signal. A duty cycle of the PWM signal may be varied from about 0% to about 100% to vary the power of the TED array 344 from about 0% to about 100% of full power. The value of the duty cycle of the PWM signal may be set according to sensor data received by the control module 308 from the various temperature, current, voltage, and rpm sensors in the thermoelectric cooling system 100. Additionally, the value of the duty cycle may be set according to a set mode of operation of the thermoelectric cooling system 100, e.g., refrigeration mode, beverage chilling mode, freezer mode, or defrost mode. When the PWM duty cycle is increased, the TED array 344 may provide more cooling to the chilled compartment 110, and when the PWM duty cycle is reduced, the TED array 344 may provide less cooling to the chilled compartment 110.

Figure 4:
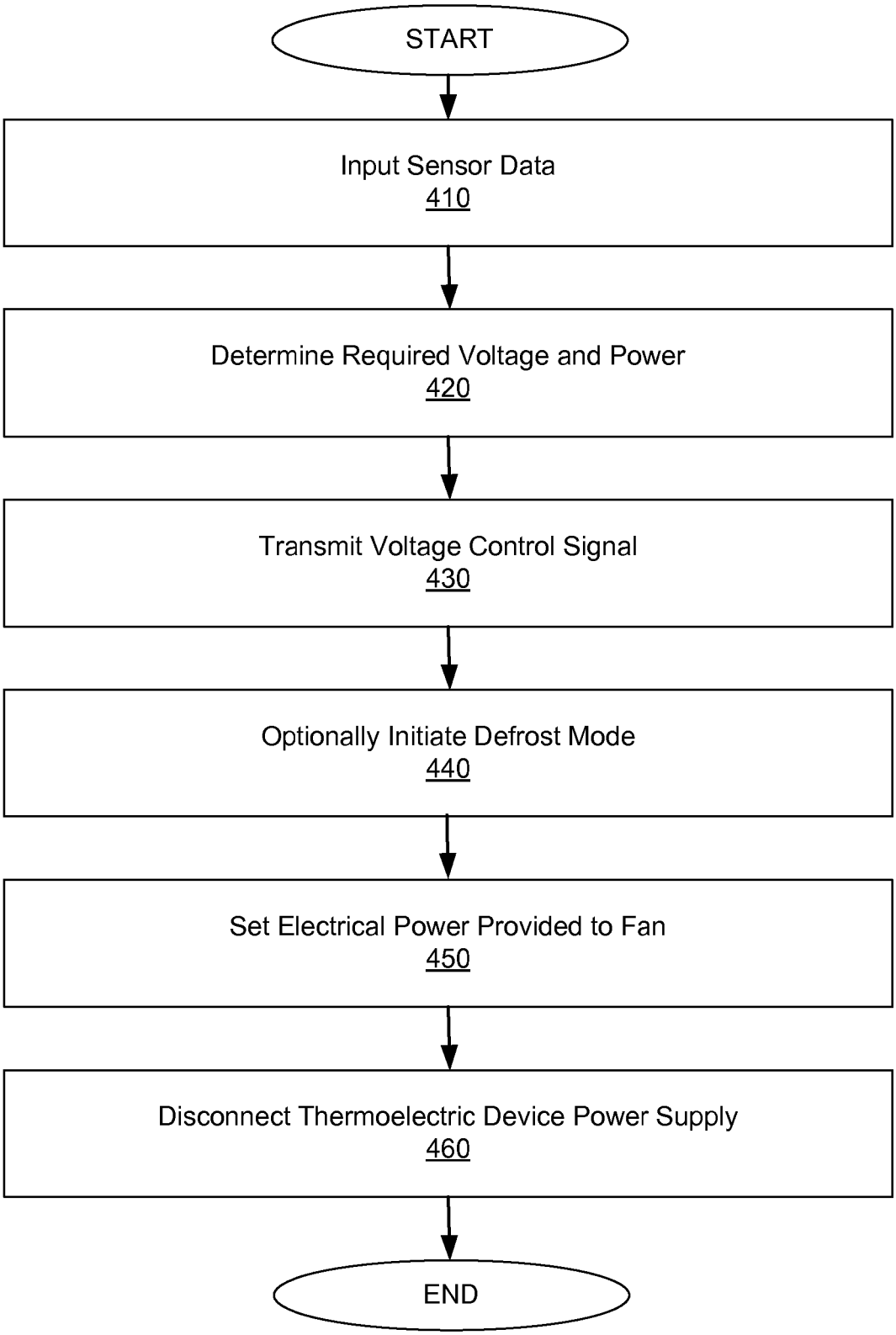
FIG. 4 illustrates an exemplary method of controlling the thermoelectric cooling system.

FIG. 4 illustrates an exemplary method of controlling the thermoelectric cooling system 300. The steps illustrated in FIG. 4 may be performed by a processor of the control module 308. While the steps are illustrated in a particular order in the illustrated embodiment, the order in which the steps may be performed is not limited to the illustrated embodiment, and the steps may be performed in other orders in other embodiments. In addition, some embodiments may not perform all illustrated steps or may include additional steps not illustrated in FIG. 4.

In a step 410, sensor data is input to the control module 308 from one or more sensors of the thermoelectric cooling system 300. The sensor data may be used as input to a control algorithm for controlling the thermoelectric cooling system 300 and constituent components.

In a step 420, a required voltage and power is determined. A voltage control signal parameter may be determined based on at least the input sensor data. The voltage control signal parameter may include a percentage of maximum voltage to be applied in a variable voltage control system, a PWM duty cycle in a PWM control system, or whether the voltage control is "on" or "off" in an on/off voltage control system. In a PWM control system, the PWM duty cycle may be applied to a pulse train having a predetermined frequency, e.g., 2 kHz or greater, to generate a PWM signal having the PWM duty cycle.

In a step 430, the voltage control signal having the voltage control signal parameter determined in step 420 is transmitted to the driver 338 to control heat transfer by the plurality of thermoelectric devices 345-360 of the TED array 344. The voltage control signal may be processed or logically operated upon between the control module 308 and the driver 338. For example, the voltage control signal may be inverted, amplified, filtered, level-shifted, latched, blocked, or overridden by a component disposed between the control module 308 and the driver 338 along a path of the voltage control signal, such as the NAND circuit 334. The TED array 344 may perform heat transfer from one side to the other side using the Peltier effect in proportion to the parameter of the voltage control signal applied to the driver 338.

In a step 440, a defrost mode may optionally be initiated by transmitting a polarity switch signal to the polarity switch 328 to reverse a voltage polarity of the electrical power provided to the plurality of thermoelectric devices 345-360 of the TED array 344. By reversing the polarity in step 440, a direction of heat transfer between a first side and a second side of the plurality of thermoelectric devices 345-360 of the TED array 344 is changed. The polarity switch signal may be processed or logically operated upon between the control module 308 and the polarity switch 328. In addition, the polarity switch signal may be used to control a logical operation performed on another signal such as the voltage control signal.

In a step 450, electrical power provided to the fan 135 is set to control a speed of the fan based on at least one of the sensor data input in step 410. Voltage and/or current may be set to variably control the electrical power provided to the fan 135 according to a desired fan speed. By controlling the speed of the fan, the air flow of the fan is also controlled.

In a step 460, the VDC BUS2 power supply 314 is disconnected from the power input 302 using the relay 316 based on at least the sensor data input in step 410. Thus, the thermoelectric device array 344 and the thermoelectric cooling system 300 can be protected from errors and safety problems such as over-current or over-heat conditions.

FIGS. 5A, 5B, 5C, 5D, 5E, and 5F illustrate another exemplary method of controlling the thermoelectric cooling system. All values and ranges (e.g., voltage values, current values, temperature values, number of power phases, number of TED channels, etc.) given in the following description are exemplary only, and in some embodiments, different values may be used without departing from the spirit and scope of the invention as defined in the claims. In a step 501, a galley cart including a thermoelectric refrigerator having the thermoelectric cooling system is inserted into a galley panel. In a step 502, the thermoelectric cooling system enters a pre-power-up standby mode in which most functionality is non-operational. In a step 503, input power to the thermoelectric cooling system is monitored to determine power characteristics such as input voltage level and frequency. In a step 504, a determination is made as to whether acceptable two phase power for operating the thermoelectric cooling system is available. If the voltage level is in a specified acceptable range, such as a value within approximately 80 VAC to 180 VAC, having a frequency between approximately 360 Hz to 800 Hz, and there are at least two distinct power phases available, the determination may be made that acceptable two phase power is available. If acceptable two phase power is not available, the method may return to step 502. If acceptable two phase power is available, the method may advance to a step 505. In step 505, a host microcontroller (e.g., a processor in the control section 210 or input/output and control module 308) begins operating. In a step 506, a power button of a control panel of the thermoelectric refrigerator is monitored until the power button is pressed to turn on the power. After a press of the power button is monitored, the method advances to a step 507 in which the thermoelectric cooling system enters a ready mode.

If three phase AC power is determined to not be available in a step 508, a voltage input to the thermoelectric cooling system is determined to be unacceptable (e.g., less than approximately 80 VAC or greater than approximately 180 VAC) in a step 509, a hot side temperature of the TEDs 345-360 in the TED array 344 is determined to be unacceptable (e.g., greater than approximately 180 degrees Fahrenheit) in a step 510, or an electrical current of the TEDs 345-360 in the TED array 344 is determined to be unacceptable (e.g., greater than approximately 20 amps rms (Arms)) in a step 511, the method enters a self protect mode in a step 512. The self protect mode entered in step 512 is described further with reference to FIG. 5F. Otherwise, the method enters a mode selection step 513 in which a an operating mode of the thermoelectric cooling system is set. The operating mode may be one of a freezer mode, a refrigerator mode, a beverage chiller mode, or another mode which may be a variant of one of these modes described herein.

After an operating mode of the thermoelectric cooling system is selected in step 513, software or firmware that executes on the host microcontroller to control the thermoelectric cooling system is enabled and the polarity switch 328 that reverses the DC polarity of the TED array 344 is disabled in a step 514. If the freezer mode was selected in step 513, the method next continues to a freezer mode in step 515, which is described in further detail with reference to FIG. 5B. In the freezer mode, a freezing temperature set point, such as −12 degrees centrigrade, may be set. If the refrigerator mode was selected in step 513, the method next continues to a refrigerator mode in step 516. In the refrigerator mode, a cold but non-freezing temperature set point, such as 4 degrees centigrade, may be set. After the refrigerator mode is entered in step 516, the method continues to a temperature control mode in a step 518, which is described in further detail with reference to FIG. 5C. If the beverage chiller mode was selected in step 513, the method next continues to a beverage chiller mode in step 517, which is described in further detail with reference to FIG. 5D. In the beverage chiller mode, a cool temperature set point lower than room temperature but higher than a freezer or refrigerator mode, such as 8 degrees centrigrade, may be set. In various embodiments, the thermoelectric cooling system may have additional modes which may be selected in step 513, and to which control may pass after step 514 instead of the freezer mode of step 515, refrigerator mode of step 516, and beverage chiller mode of step 517 described herein. Such additional modes may have different temperature set points. In various embodiments, the temperature set points of all modes of the thermoelectric cooling system may be set by a user.

Figure 5A:
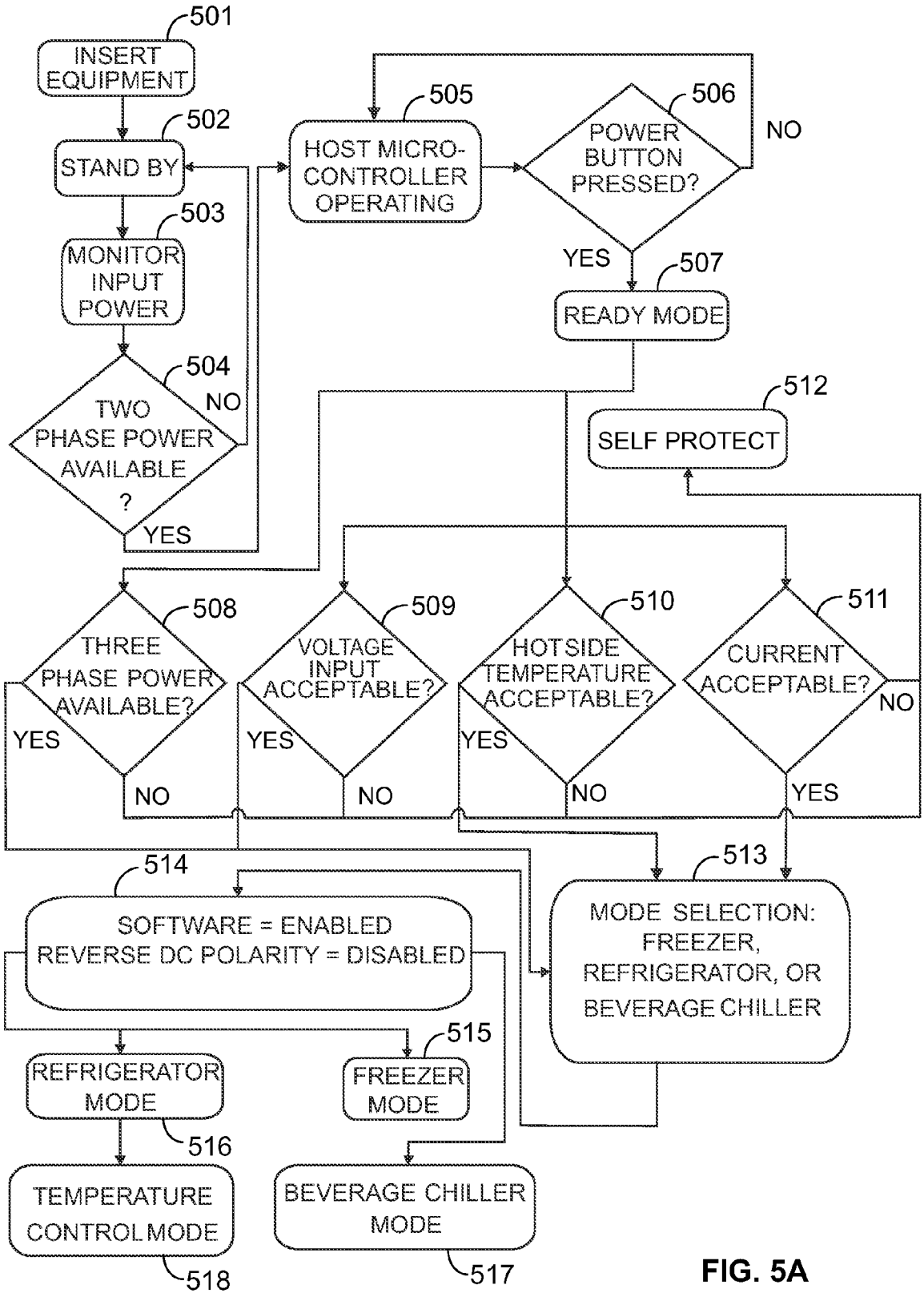
FIGS. 5A, 5B, 5C, 5D, 5E, and 5F illustrate another exemplary method of controlling the thermoelectric cooling system.
Figure 5B:
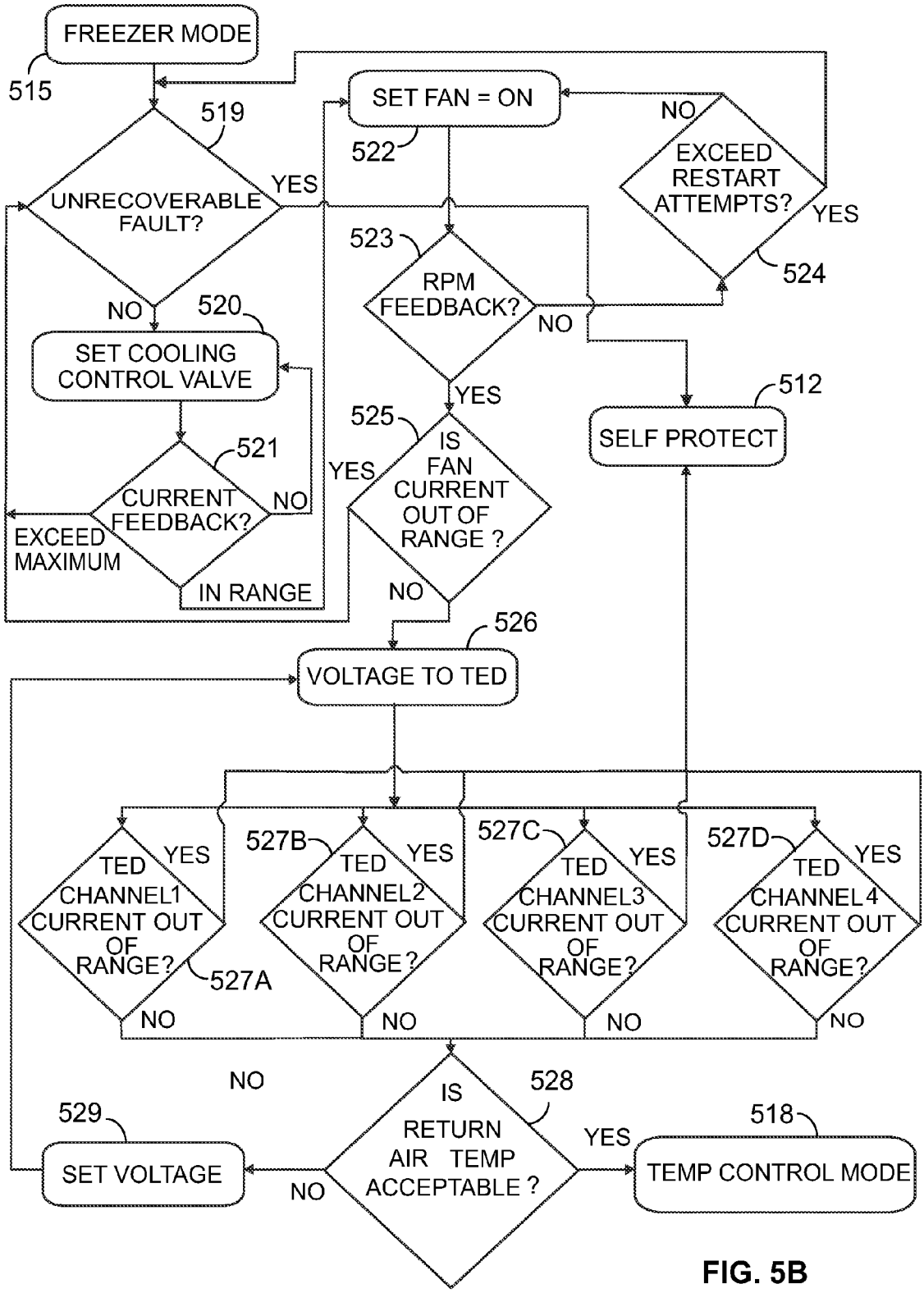

After the freezer mode is entered in step 515 as illustrated in FIG. 5B, the thermoelectric cooling system enters a standby mode which monitors for an unrecoverable fault in step 519. If an unrecoverable fault is detected, the method advances to the self protect mode in step 512, which is described further with reference to FIG. 5F. Otherwise, the method advances to a step 520 in which a cooling control valve (CCV) is set (e.g., 100% open). In a step 521, electrical current feedback due to the cooling control valve being set in step 520 is measured. If there is no measurable current feedback, or the current value is less than some specified minimum value, the method returns to step 520 to set the cooling control valve again. If the measured current feedback in step 521 exceeds a maximum value, such as 1 A, the method returns to standby mode in step 519. Otherwise, if the current feedback is within an acceptable range, the method advances to a step 522 in which the fan (e.g., fan 135) is set to be on.

After the fan is set to be on, the fan speed rpm feedback is monitored in a step 523. If a determination is made that there is no measurable rpm feedback, an attempt to restart the fan is made and the number of attempts are counted in a step 524. When the number of fan restart attempts equals a threshold value (e.g., five restart attempts), the method returns to the standby mode in step 519. Otherwise, the fan is reset to be on again in step 522. When rpm feedback from the fan is measured in step 523 (e.g., using fan rpm sensor 384), the method advances to a step 525 in which a determination is made regarding whether an electrical current of the fan, which may be measured by current sensor 382, is out of an acceptable range for a specified extended period of time. For example, the electrical current may be determined to be out of an acceptable range for an extended period of time if the current exceeds approximately 4 A for approximately 4 seconds or more. If the fan current is out of an acceptable range for an extended period of time, the method returns to the standby mode in step 519. The measurement of the fan current over an extended period of time allows initial spikes in the fan current when the fan is first turned on to be ignored when determining if the fan is operating properly.

If the fan current is not out of an acceptable range for a specified extended period of time, the method advances to a step 526 in which a voltage signal is transmitted to control the TED array 344, for example via the driver 338. In various embodiments, the voltage signal may be a pulse width modulation (PWM) signal, a linear variable voltage signal, or an on/off voltage signal. Thereafter, electrical current in each of the channels of the TED array 344 is monitored (e.g., channels 1, 2, 3, and 4 may be monitored using current sensors 362, 364, 366, and 368, respectively) and a determination is made regarding whether the monitored current is out of an acceptable range in step 527A, 527B, 527C, and 527D. In some embodiments, a measured current may be determined to be out of an acceptable range if the current is essentially zero or exceeds approximately 5 Arms. If a monitored current in any of the channels is determined to be out of an acceptable range, the method advances to the self protect mode in step 512, which is described in further detail with reference to FIG. 5F. If the current is determined to be within an acceptable range, the method continues to step 528 in which a determination is made as to whether a return air temperature (e.g., a temperature of air flow 170 as measured by temperature sensor 378) is within an acceptable range. In some embodiments, an acceptable range may be considered to be at or below approximately −12 degrees centigrade. If the return air temperature is not determined to be within an acceptable range, the voltage signal to the TED array 344 is set again in a step 529 and the method returns to step 526. In some embodiments, the voltage signal to the TED array 344 may be set to its maximum value in order to pull the temperature of the thermoelectric cooling system down to the freezer temperature set point as quickly as possible. If the return air temperature is determined to be within an acceptable range, the method advances to the temperature control mode in step 518, as described in more detail with reference to FIG. 5C.

Figure 5C:
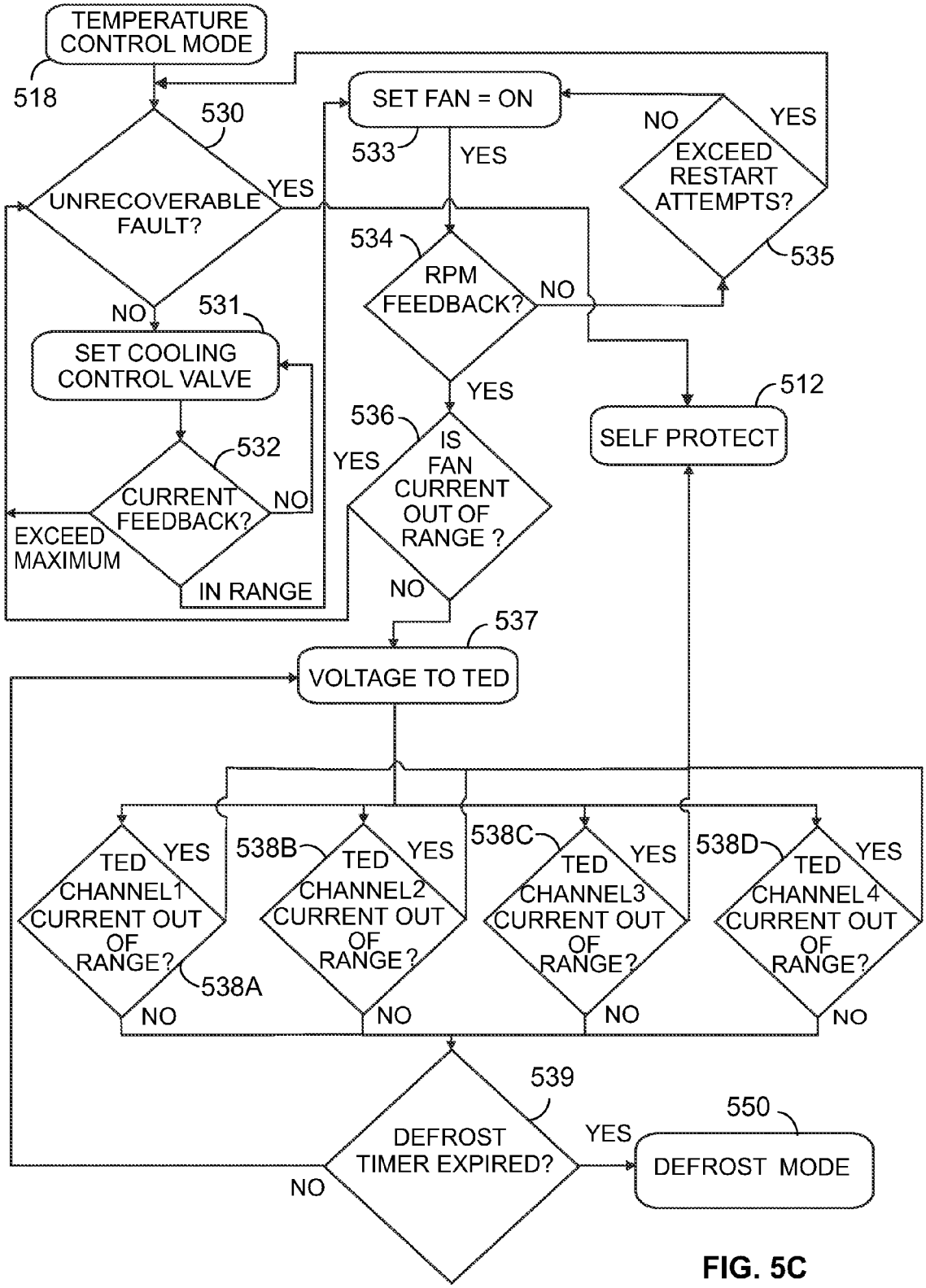

The temperature control mode entered in step 518 and illustrated in FIG. 5C controls a temperature of the thermoelectric cooling system according to the temperature set point of the mode set in step 513. For example, a freezer mode temperature set point may be approximately −12 degrees centigrade, a refrigerator mode temperature set point may be approximately 4 degrees centigrade, and a beverage chiller mode temperature set point may be approximately 8 degrees centigrade. After entering the temperature control mode in step 518, the thermoelectric cooling system enters a standby mode which monitors for an unrecoverable fault in step 530. If an unrecoverable fault is detected, the method advances to the self protect mode in step 512, which is described further with reference to FIG. 5F. Otherwise, the method advances to a step 531 in which a cooling control valve (CCV) is set (e.g., 100% open). In a step 532, current feedback due to the cooling control valve being set in step 531 is measured. If there is no measurable current feedback, or the current value is less than some specified minimum value, the method returns to step 531 to set the cooling control valve again. If the measured current feedback in step 532 exceeds a maximum value, such as 1 A, the method returns to standby mode in step 530. Otherwise, if the current feedback is within an acceptable range, the method advances to a step 533 in which the fan (e.g., fan 135) is set to be on.

After the fan is set to be on, the fan speed rpm feedback is monitored in a step 534. If a determination is made that there is no measurable rpm feedback, an attempt to restart the fan is made and the number of attempts are counted in a step 535. When the number of fan restart attempts equals a threshold value (e.g., five restart attempts), the method returns to the standby mode in step 530. Otherwise, the fan is reset to be on again in step 533. When rpm feedback from the fan is measured in step 534 (e.g., using fan rpm sensor 384), the method advances to a step 536 in which a determination is made regarding whether an electrical current of the fan, which may be measured by current sensor 382, is out of an acceptable range for a specified extended period of time. For example, the electrical current may be determined to be out of an acceptable range for an extended period of time if the current exceeds approximately 4 A for approximately 4 seconds or more. If the fan current is out of range for an extended period of time, the method returns to the standby mode in step 530. The measurement of the fan current over an extended period of time allows initial spikes in the fan current when the fan is first turned on to be ignored when determining if the fan is operating properly.

If the fan current is not out of an acceptable range for a specified extended period of time, the method advances to a step 537 in which a voltage signal is transmitted to control the TED array 344, for example via the driver 338. In various embodiments, the voltage signal may be a pulse width modulation (PWM) signal, a linear variable voltage signal, or an on/off voltage signal. Thereafter, electrical current in each of the channels of the TED array 344 is monitored (e.g., channels 1, 2, 3, and 4 may be monitored using current sensors 362, 364, 366, and 368, respectively) and a determination is made regarding whether the monitored current is out of an acceptable range in steps 538A, 538B, 538C, and 538D. In some embodiments, a measured current may be determined to be out of an acceptable range if the current is essentially zero or exceeds approximately 5 Arms. If a monitored current in any of the channels is determined to be out of an acceptable range, the method advances to the self protect mode in step 512, which is described in further detail with reference to FIG. 5F. If the current is determined to be within an acceptable range, the method continues to step 539 in which a determination is made as to whether a defrost timer has expired. The defrost timer determines the frequency with which the thermoelectric cooling system enters a defrost mode, for example, once every some specified number of hours of continuous operation. When the defrost timer has not expired in step 539, the method returns to step 537 and a voltage signal continues to be transmitited to control the TED array 344. If the defrost timer is determined to be expired, the method advances to the defrost mode in step 550, as described in more detail with reference to FIG. 5E.

Figure 5D:
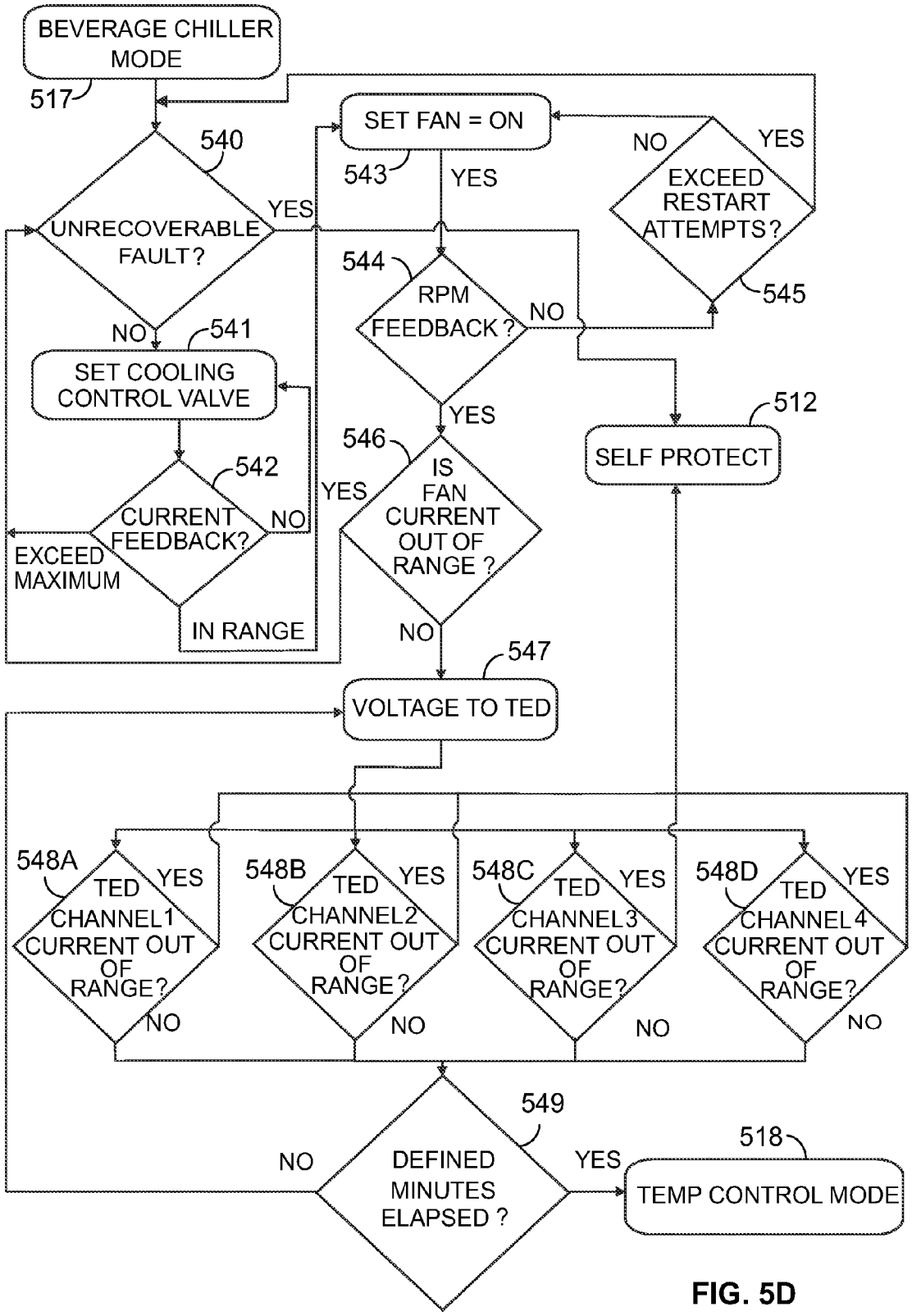

After the beverage chiller mode is entered in step 517 as illustrated in FIG. 5D, the thermoelectric cooling system enters a standby mode which monitors for an unrecoverable fault in step 540. If an unrecoverable fault is detected, the method advances to the self protect mode in step 512, which is described further with reference to FIG. 5F. Otherwise, the method advances to a step 541 in which a cooling control valve (CCV) is set (e.g., 100% open). In a step 542, current feedback due to the cooling control valve being set in step 541 is measured. If there is no measurable current feedback, or the current value is less than some specified minimum value, the method returns to step 541 to set the cooling control valve again. If the measured current feedback in step 542 exceeds a maximum value, such as 1 A, the method returns to standby mode in step 540. Otherwise, if the current feedback is within an acceptable range, the method advances to a step 543 in which the fan (e.g., fan 135) is set to be on.

After the fan is set to be on, the fan speed rpm feedback is monitored in a step 544. If a determination is made that there is no measurable rpm feedback, an attempt to restart the fan is made and the number of attempts are counted in a step 545. When the number of fan restart attempts equals a threshold value (e.g., five restart attempts), the method returns to the standby mode in step 540. Otherwise, the fan is reset to be on again in step 543. When rpm feedback from the fan is measured in step 544 (e.g., using fan rpm sensor 384), the method advances to a step 546 in which a determination is made regarding whether an electrical current of the fan, which may be measured by current sensor 382, is out of range for a specified extended period of time. For example, the electrical current may be determined to be out of range for an extended period of time if the current exceeds approximately 4 A for approximately 4 seconds or more. If the fan current is out of range for an extended period of time, the method returns to the standby mode in step 540. The measurement of the fan current over an extended period of time allows initial spikes in the fan current when the fan is first turned on to be ignored when determining if the fan is operating properly.

If the fan current does not exceed an acceptable range for the specified extended period of time, the method advances to a step 547 in which a voltage signal is transmitted to control the TED array 344, for example via the driver 338. In various embodiments, the voltage signal may be a pulse width modulation (PWM) signal, a linear variable voltage signal, or an on/off voltage signal. Thereafter, electrical current in each of the channels of the TED array 344 is monitored (e.g., channels 1, 2, 3, and 4 may be monitored using current sensors 362, 364, 366, and 368, respectively) and a determination is made regarding whether the monitored current is out of an acceptable range in steps 548A, 548B, 548C, and 548D. In some embodiments, a measured current may be determined to be out of an acceptable range if the current is essentially zero or exceeds approximately 5 Arms. If a monitored current in any of the channels is determined to be out of an acceptable range, the method advances to the self protect mode in step 512, which is described in further detail with reference to FIG. 5F. If the current is determined to be within an acceptable range, the method continues to step 549 in which a determination is made as to whether a defined period of time has elapsed. In some embodiments, the defined period of time may be considered to be some period of minutes which are required for the beverage chiller mode to stabilize before the standard temperature control mode is entered. If the defined period of time is not determined to have elapsed, the method returns to step 547. If the defined period of time is determined to have elapsed, the method advances to the temperature control mode in step 518, as described in more detail with reference to FIG. 5C.

Figure 5E:
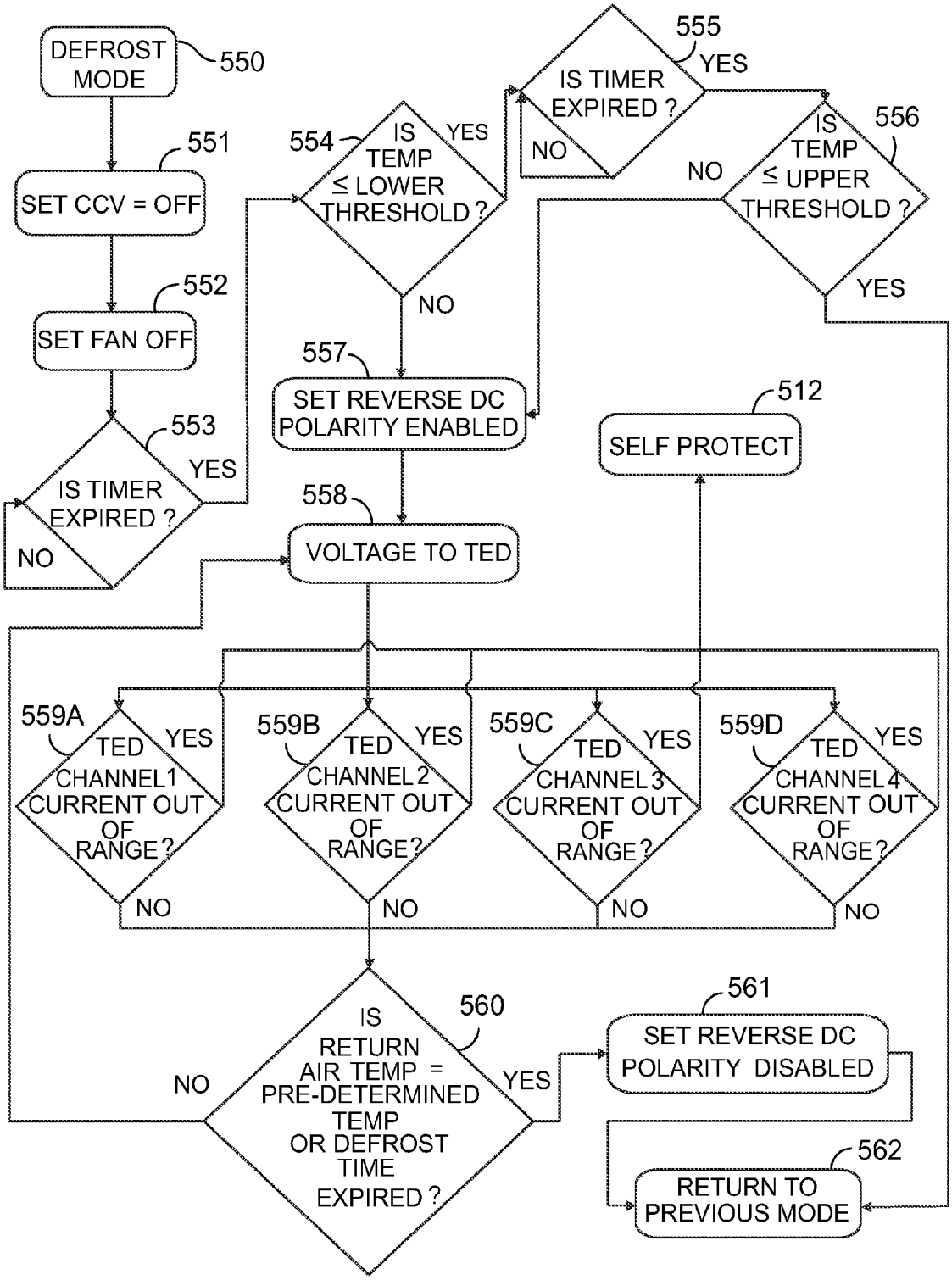

After the defrost mode is entered in step 550 as illustrated in FIG. 5E, the thermoelectric cooling system sets the cooling control valve (CCV) off in a step 551. Then, the fan is set to off in a step 552. Thereafter, a first timer runs until the timer expires in a step 553. In some embodiments, the first timer may be set to expire after 5 minutes. After the first timer expires, a temperature is compared with a lower threshold in a step 554. In some embodiments, the lower threshold may be a freezing temperature close to the freezer mode temperature set point, such as −10 degrees centigrade. If the temperature is not approximately less than or equal to the lower threshold, the method advances to a step 557 to commence the defrost operation. If the temperature is approximately less than or equal to the lower threshold, the method advances to a step 555 in which a second timer runs until the second timer expires. The second timer may be longer than the first timer of step 553. For example, in some embodiments, the second timer may be set to expire after 30 minutes to allow the temperature to naturally rise further. After the second timer expires, the method advances to a step 556 in which the temperature is compared with an upper threshold. In some embodiments, the upper threshold may be a freezing temperature higher than the lower threshold, such as −3 degrees centigrade. If the temperature is not approximately less than or equal to the upper threshold, the method advances to step 557 to commence the defrost operation. Otherwise, if the temperature is approximately less than or equal to the upper threshold, the method returns to the previous mode before the defrost mode was entered in a step 562, such as the temperature control mode 518 as described further with reference to FIG. 5C.

When the method advances to the step 557, the DC polarity of the TED array 344 is reversed using the polarity switch 328. Thereafter, in a step 558, a voltage signal is transmitted to control the TED array 344, for example via the driver 338. In various embodiments, the voltage signal may be a pulse width modulation (PWM) signal, a linear variable voltage signal, or an on/off voltage signal. Electrical current in each of the channels of the TED array 344 is then monitored (e.g., channels 1, 2, 3, and 4 may be monitored using current sensors 362, 364, 366, and 368, respectively) and a determination is made regarding whether the monitored current is out of an acceptable range in steps 559A, 559B, 559C, and 559D. In some embodiments, a measured current may be determined to be out of an acceptable range if the current is essentially zero or exceeds approximately 5 Arms. If a monitored current in any of the channels is determined to be out of an acceptable range, the method advances to the self protect mode in step 512, which is described in further detail with reference to FIG. 5F. If the current is determined to be within an acceptable range, the method continues to a step 560 in which a determination is made as to whether a return air temperature has reached a predetermined defrost completion temperature (e.g., 1 degree centigrade) or a defrost cycle time has expired (e.g., 45 minutes). If the defined temperature is not determined to have been reached and the defined period of time is not determined to have elapsed, the method returns to step 558. Otherwise, reversal of the DC polarity of the TED array 344 is disabled using the polarity switch 328 in a step 561 and the method returns to the previous mode in step 562, such as the temperature control mode in step 518 as described in more detail with reference to FIG. 5C.

Figure 5F:
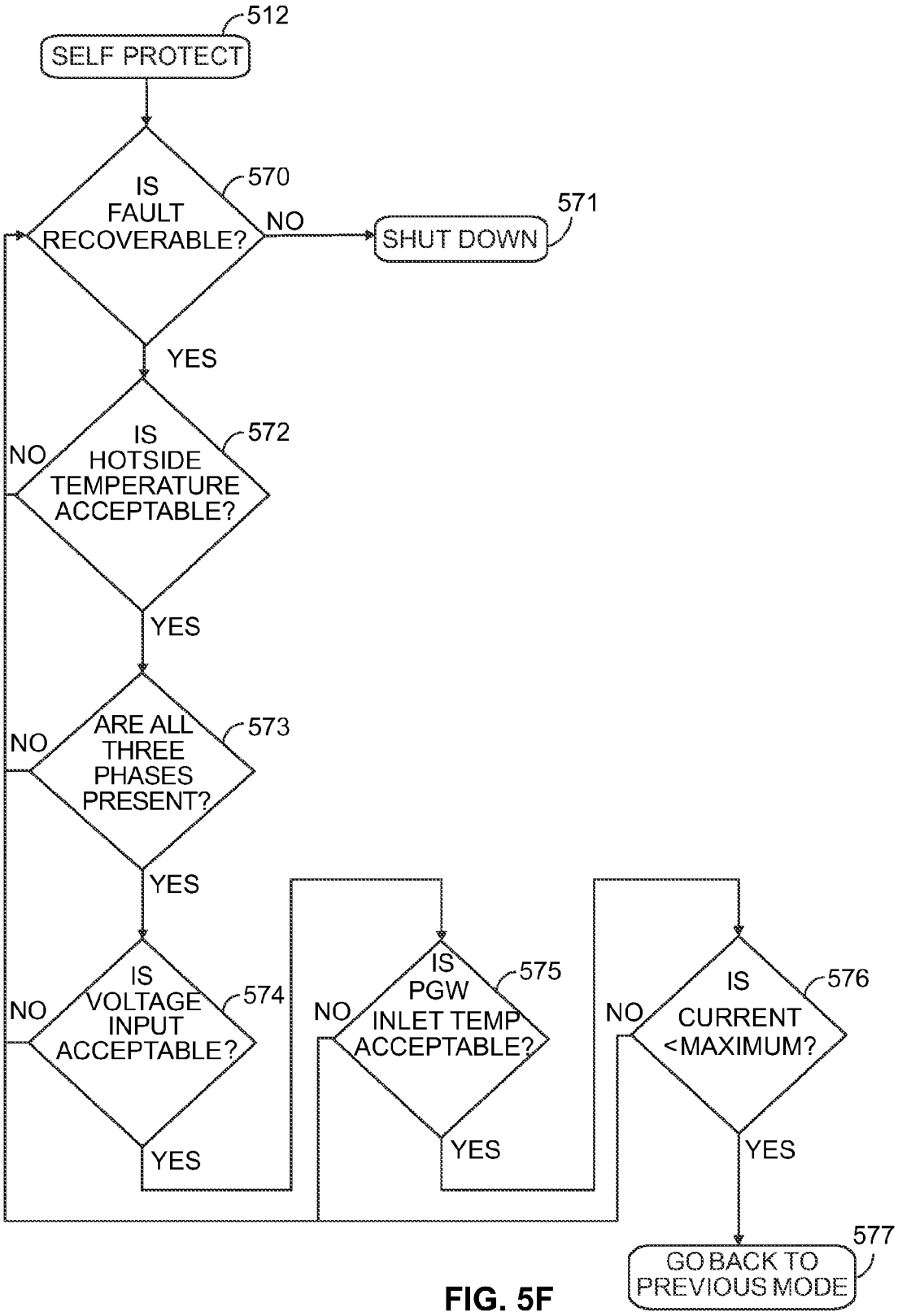

During the self protect mode which is entered in step 512, described with reference to FIG. 5F, each fault condition which is detected is reported to the host microcontroller. After the self protect mode is entered, a determination is made in a standby state regarding whether a fault is recoverable in a step 570. If the determination is made that a fault is not recoverable, the thermoelectric cooling system is shut down in a step 571. Otherwise, a series of comparisons of measurements with acceptable values are performed to determine whether the thermoelectric cooling system can resume operation in the mode just prior to entering the self protect mode, as described below. If any measurement is determined to be unacceptable, the method returns to the standby mode in step 570 to determine whether the fault is recoverable. In a step 572, a determination is made regarding whether the hot side temperature of the TEDs 345-360 of the TED array 344 is acceptable. An acceptable temperature of the hot side of the TEDs may be approximately less than or equal to 82 degrees centigrade. In a step 573, a determination is made regarding whether all three phases of power are present. In a step 574, a determination is made regarding whether a voltage input to the thermoelectric cooling system is acceptable. An acceptable voltage input may be between approximately 80 VAC and 180 VAC. In a step 575, a determination is made regarding whether the propylene glycol and water (PGW) temperature at the coolant inlet (e.g., liquid inlet temperature at coolant input port 150 as measured by temperature sensor 386) is acceptable. The liquid inlet temperature may be considered to be acceptable when less than or equal to approximately −2 degrees centigrade. In a step 576, a determination is made regarding whether the total current of the TEDs 345-360 in the TED array 344 is acceptable. The total TED current may be considered acceptable when less than approximately 20 Arms. If all measurements in the self protect mode are acceptable, the method returns in a step 577 to the mode of the thermoelectric cooling system prior to entering the self protect mode. For example, the method may return to the ready mode in step 507, the freezer standby mode in step 519, the freezer voltage to TED mode in step 516, the temperature control standby mode in step 530, the temperature control voltage to TED mode in step 537, the beverage chiller standby mode in step 540, the beverage chiller voltage to TED mode in step 547, or the defrost voltage to TED mode in step 558.

Functions of the control system described herein may be controlled by a controller according to instructions of a software program stored on a non-transient storage medium which may be read and executed by a processor of the controller. The software program may be written in a computer programming language (e.g., C, C++, etc.) and cross-compiled to be executed on the processor of the controller. Examples of the storage medium include magnetic storage media (e.g., floppy disks, hard disks, or magnetic tape), optical recording media (e.g., CD-ROMs or digital versatile disks (DVDs)), and electronic storage media (e.g., integrated circuits (IC's), ROM, RAM, EEPROM, or flash memory). The storage medium may also be distributed over network-coupled computer systems so that the program instructions are stored and executed in a distributed fashion.

Embodiments may be described in terms of functional block components and various processing steps. Such functional blocks may be realized by any number of hardware and/or software components configured to perform the specified functions. For example, the embodiments may employ various integrated circuit components, e.g., memory elements, processing elements, logic elements, look-up tables, and the like, which may carry out a variety of functions under the control of one or more microprocessors or other control devices. Similarly, where the elements of the embodiments are implemented using software programming or software elements, the embodiments may be implemented with any programming or scripting language such as C, C++, Java, assembler, or the like, with the various algorithms being implemented with any combination of data structures, objects, processes, routines or other programming elements. Furthermore, the embodiments could employ any number of conventional techniques for electronics configuration, signal processing and/or control, data processing and the like. The word mechanism is used broadly and is not limited to mechanical or physical embodiments, but can include software routines in conjunction with processors, etc.

The particular implementations shown and described herein are illustrative examples of the embodiments and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. The use of any and all examples, or exemplary language (e.g., "such as") provided herein, is intended merely to better illuminate the embodiments and does not pose a limitation on the scope of the invention unless otherwise claimed. Moreover, no item or component is essential to the practice of the invention unless the element is specifically described as "essential" or "critical".

As these embodiments are described with reference to illustrations, various modifications or adaptations of the methods and or specific structures described may become apparent to those skilled in the art. All such modifications, adaptations, or variations that rely upon the teachings of the embodiments, and through which these teachings have advanced the art, are considered to be within the spirit and scope of the invention. Hence, these descriptions and drawings should not be considered in a limiting sense, as it is understood that the invention is in no way limited to only the embodiments illustrated.

It will be recognized that the terms "comprising," "including," and "having," as used herein, are specifically intended to be read as open-ended terms of art. The use of the terms "a" and "and" and "the" and similar referents in the context of describing the embodiments (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context.

What is claimed is:

1. A controller for a thermoelectric cooling system of a vehicle comprising:

a sensor input that receives input from a sensor that measures a performance parameter of a thermoelectric cooling system comprising a plurality of thermoelectric devices electrically coupled in parallel with one another, electrically driven by a common driver using DC power provided by a power supply that converts multiple-phase AC power from the vehicle to DC power, and thermally coupled in parallel with one another to cool a common space or object in the vehicle;

a voltage control signal output;

a processor;

a non-transitory memory having stored thereon a program executable by the processor to perform a method of controlling the thermoelectric cooling system, the method comprising:

determining whether multiple-phase AC power is available at the power supply, and when multiple-phase AC power is available:

receiving sensor data from the sensor input;

determining a parameter of a voltage control signal based on the input sensor data; and transmitting the voltage control signal having the parameter to the driver to control heat transfer by the plurality of thermoelectric devices.

2. The controller of claim 1, wherein the voltage control signal is a linearly variable voltage control signal and the parameter of the variable voltage control signal is a percentage of maximum voltage of the variable voltage control signal.

3. The controller of claim 1, wherein the voltage control signal is a pulse width modulation signal and the parameter of the voltage control signal is a pulse width modulation duty cycle.

4. The controller of claim 1, wherein the sensor input comprises a plurality of thermoelectric device sensor inputs, each of which receives input from a sensor that measures a performance parameter of a respective one of the plurality of thermoelectric devices.

5. The controller of claim 1, wherein the sensor input comprises a fan sensor input that receives input from a sensor that measures a performance parameter of a fan that circulates air on one side of the plurality of thermoelectric devices, wherein the controller further comprises a fan control output that controls operation of the fan, and wherein the method further comprises setting an electrical power provided to the fan to control a speed of the fan according to the sensor input.

6. The controller of claim 1, wherein the sensor input comprises a fluid coolant temperature sensor input that receives input from a sensor that measures a temperature of a fluid coolant that circulates on one side of the plurality of thermoelectric devices.

7. The controller of claim 1, wherein the sensor input comprises a circulating air temperature sensor input that receives input from a sensor that measures a temperature of air that circulates on one side of the plurality of thermoelectric devices.

8. The controller of claim 1, wherein the sensor input comprises a thermoelectric device temperature sensor input that receives input from a sensor that measures a temperature of one side of at least one of the plurality of thermoelectric devices.

9. The controller of claim 1, wherein the sensor input comprises a thermoelectric device current sensor input that receives input from a sensor that measures an electrical current that passes through at least one of the plurality of thermoelectric devices.

10. The controller of claim 1, wherein the controller further comprises a polarity switch signal output that controls operation of a polarity switch electrically coupled in series with the driver and operative to reverse a voltage polarity of electrical power provided to the plurality of thermoelectric devices, and wherein the voltage control signal output to the driver is overridden by the polarity switch signal output.

11. The controller of claim 1, wherein the controller is electrically isolated from the plurality of thermoelectric devices.

12. A thermoelectric cooling system of a vehicle comprising:

a first plurality of thermoelectric devices electrically coupled in series with a power supply;

a second plurality of thermoelectric devices electrically coupled in series, the first plurality and the second plurality electrically coupled in parallel with one another;

a cold plate coupled with a first side of the first plurality and second plurality of thermoelectric devices and operative to transfer heat from air in thermal contact with the cold plate to the first plurality and second plurality of thermoelectric devices;

a heat sink coupled with a second side of the first plurality and second plurality of thermoelectric devices, coupled with a central liquid coolant system of the vehicle to circulate liquid coolant cooled by the central liquid coolant system through the heat sink, and operative to transfer heat from the second side to the liquid coolant in thermal contact with the heat sink;

a driver electrically coupled in series between the power supply on one side and the first plurality and the second plurality of thermoelectric devices on another side, the driver operative to control an amount of electrical power provided to the first plurality and the second plurality of thermoelectric devices from the power supply according to a voltage control signal;

a sensor that measures a performance parameter of at least one of the first plurality and second plurality of thermoelectric devices; and a controller including a processor and a non-transitory memory having stored thereon a program executable by the processor to perform a method of controlling the thermoelectric cooling system, the method comprising:

receiving sensor data from the sensor;

determining a parameter of the voltage control signal based on the sensor data; and transmitting the voltage control signal to the driver.

13. The thermoelectric cooling system of claim 12, wherein the voltage control signal is a linearly variable voltage control signal and the parameter of the variable voltage control signal is a percentage of maximum voltage of the variable voltage control signal.

14. The thermoelectric cooling system of claim 12, wherein the voltage control signal is a pulse width modulation signal and the parameter of the voltage control signal is a pulse width modulation duty cycle.

15. The thermoelectric cooling system of claim 12, wherein the sensor includes a first electrical current sensor that measures electrical current that passes through the first plurality of thermoelectric devices and a second electrical current sensor that measures electrical current that passes through the second plurality of thermoelectric devices.

16. The thermoelectric cooling system of claim 12, wherein the sensor includes a first electrical voltage sensor that measures electrical voltage input to the first plurality and the second plurality of thermoelectric devices.

17. The thermoelectric cooling system of claim 12, wherein the sensor includes a first temperature sensor that measures a temperature of the first side of at least one of the first plurality and the second plurality of thermoelectric devices and a second temperature sensor that measures a temperature of the second side of the at least one of the first plurality and the second plurality of thermoelectric devices.

18. The thermoelectric cooling system of claim 12, wherein the sensor includes a fluid temperature sensor that measures a temperature of the liquid coolant in thermal contact with the heat sink.

19. The thermoelectric cooling system of claim 12, further comprising a polarity switch electrically coupled in series with the driver, and wherein the method performed by the controller further comprises transmitting a polarity switch signal to the polarity switch to reverse a voltage polarity of the electrical power provided to the first plurality and the second plurality of thermoelectric devices to change a direction of heat transfer between the first side and the second side of the first plurality and the second plurality of thermoelectric devices.

20. The thermoelectric cooling system of claim 12, wherein the controller is electrically isolated from the first plurality and the second plurality of thermoelectric devices and the power supply.

21. The thermoelectric cooling system of claim 12, further comprising:

a fan operative to circulate air between thermal contact with the cold plate and a chilled compartment, and a rotational speed sensor that measures revolutions per unit time of the fan; and wherein the method performed by the controller further comprises:

receiving rotational speed sensor data from the rotational speed sensor, and setting an electrical power provided to the fan to control a speed of the fan based on at least one of the sensor data and the rotational speed sensor data.

22. The thermoelectric cooling system of claim 12, further comprising:

a fan operative to circulate air between thermal contact with the cold plate and a chilled compartment, and a temperature sensor that measures a temperature of an air flow of the circulated air; and wherein the method performed by the controller further comprises:

receiving temperature sensor data from the temperature sensor, and setting an electrical power provided to the fan to control a speed of the fan based on at least one of the sensor data and the temperature sensor data.

23. A thermoelectric refrigerator of a vehicle comprising:

a chilled compartment that holds food or beverages at a temperature lower than an ambient air temperature;

a plurality of thermoelectric devices electrically coupled in parallel with one another, the plurality of thermoelectric devices having a cold side and a hot side;

a fan that circulates air between thermal contact with the cold side of the plurality of thermoelectric devices and an interior of the chilled compartment and driven by variably controlled electrical power;

a heat sink in thermal contact with the hot side of the plurality of thermoelectric devices, coupled with a central liquid coolant system of the vehicle to circulate liquid coolant cooled by the central liquid coolant system through the heat sink, and that transfers heat between the hot side of the plurality of thermoelectric devices and the liquid coolant that circulates in thermal contact therewith;

a thermoelectric device power supply electrically coupled with the plurality of thermoelectric devices and that converts multiple-phase AC power from an input power source of the vehicle to DC power to drive the plurality of thermoelectric devices;

a control system power supply electrically coupled with a controller that is electrically isolated from the plurality of thermoelectric devices and that converts power from the input power source to power the controller;

a driver electrically coupled in series with the plurality of thermoelectric devices and that controls electrical current from the thermoelectric device power supply input to the plurality of thermoelectric devices in response to a thermoelectric device driving signal;

a current sensor electrically coupled with at least one of the plurality of thermoelectric devices and that measures electrical current that passes therethrough;

a voltage sensor electrically coupled with the plurality of thermoelectric devices and that measures an electrical voltage input to the plurality of thermoelectric devices;

a thermoelectric device temperature sensor thermally coupled with one side of at least one of the plurality of thermoelectric devices and that measures a temperature of the one side of the at least one of the plurality of thermoelectric devices;

a circulating air temperature sensor that measures a temperature of air that circulates in thermal contact with the cold side of the plurality of thermoelectric devices;

a liquid coolant temperature sensor that measures a temperature of the liquid coolant that circulates in thermal contact with the heat sink on the hot side of the plurality of thermoelectric devices; and a controller including a processor and a non-transitory memory having stored thereon a program executable by the processor to perform a method of controlling the thermoelectric refrigerator, the method comprising:

determining whether multiple-phase AC power is available at the input power source, and when multiple-phase AC power is available:

receiving sensor data from a plurality of sensors including the current sensor, the voltage sensor, and the temperature sensors;

determining a parameter of the thermoelectric device driving signal based on at least the sensor data;

transmitting the thermoelectric device driving signal having the parameter to the driver; and setting the variably controlled electrical power driving the fan based on the sensor data.

24. The thermoelectric refrigerator of claim 23, wherein the thermoelectric device driving signal is a linearly variable voltage signal and the parameter of the thermoelectric device driving signal is a percentage of maximum voltage of the thermoelectric device driving signal.

25. The thermoelectric refrigerator of claim 23, wherein the thermoelectric device driving signal is a pulse width modulation signal and the parameter of the thermoelectric device driving signal is a pulse width modulation duty cycle.

26. The thermoelectric refrigerator of claim 23, wherein each of the plurality of thermoelectric devices electrically coupled in parallel with one another includes a plurality of thermoelectric devices electrically coupled in series with one another.

27. The thermoelectric refrigerator of claim 23, further comprising a polarity switch electrically coupled in series with the driver and that controls a voltage polarity of the plurality of thermoelectric devices in response to a thermoelectric device polarity signal; and wherein the method performed by the controller further comprises transmitting the thermoelectric device polarity signal based on whether a defrost mode of the thermoelectric refrigerator is active.

28. The thermoelectric refrigerator of claim 23, wherein the method performed by the controller further comprises disconnecting the thermoelectric device power supply from the power input based on at least the sensor data.

* * * * *